US006618868B2

(12) United States Patent
Minnick

(10) Patent No.: US 6,618,868 B2
(45) Date of Patent: Sep. 16, 2003

(54) LIGHTWEIGHT INSULATED SPA COVER AND METHOD THEREFOR

(76) Inventor: Jeff F. Minnick, 40 Chevez Ranch Rd., Sedona, AZ (US) 86336

( * ) Notice: Subject to any disclaimer, the term of this patent is extended or adjusted under 35 U.S.C. 154(b) by 0 days.

(21) Appl. No.: 09/781,092

(22) Filed: Feb. 12, 2001

(65) Prior Publication Data

US 2002/0108170 A1 Aug. 15, 2002

(51) Int. Cl.[7] ..... E04H 4/00
(52) U.S. Cl. ..... 4/498; 4/580; 4/584
(58) Field of Search ..... 4/498, 580, 584; 220/592.21, 592.24, 592.25, 592.26, 592.01, 254; 150/165, 154

(56) References Cited

U.S. PATENT DOCUMENTS

| | | | | |
|---|---|---|---|---|
| 3,862,876 | A | * | 1/1975 | Graves |
| 4,192,025 | A | | 3/1980 | Hinsperger |
| 4,236,259 | A | | 12/1980 | Wendt |
| 4,246,663 | A | | 1/1981 | Aragona et al. |
| 4,270,232 | A | | 6/1981 | Ballew |
| 4,422,192 | A | | 12/1983 | Jacobs |
| D280,438 | S | * | 9/1985 | Wendt |
| 4,685,254 | A | | 8/1987 | Terreri |
| 4,847,925 | A | | 7/1989 | Perry |
| 5,086,525 | A | * | 2/1992 | Christopher |
| 5,251,460 | A | * | 10/1993 | DeMarco et al. |
| 5,373,590 | A | | 12/1994 | Svae et al. |
| 5,386,597 | A | * | 2/1995 | O'Neill |
| 5,619,759 | A | | 4/1997 | Hansen et al. |
| 5,685,032 | A | * | 11/1997 | Watkins et al. |
| 5,689,841 | A | | 11/1997 | Black et al. |
| 5,802,630 | A | | 9/1998 | Hansen et al. |
| 5,970,530 | A | | 10/1999 | Hansen et al. |
| 5,978,975 | A | * | 11/1999 | Asskaryar |
| D436,805 | S | * | 1/2001 | Haskins et al. |

FOREIGN PATENT DOCUMENTS

GB 2026056 A * 1/1980

OTHER PUBLICATIONS

Journal of A.M.A. vol. 186, No. 7; Oct. 18, 1958; p. 930; Maurice Gershman, M.D.*

* cited by examiner

*Primary Examiner*—Gregory L. Huson
*Assistant Examiner*—Khoa D. Huynh
(74) *Attorney, Agent, or Firm*—Jeffrey D. Moy; Harry M. Weiss; Weiss, Moy & Harris, P.C.

(57) ABSTRACT

A lightweight insulated cover which may be easily installed and removed from an above ground spa has a top section and four side walls coupled to the top section. The top section and the four side walls comprised of an insulated layer, and a second layer coupled to a front and back surface of the insulated layer for protecting the insulated layer from moisture generated from the above ground spa and external weather conditions.

7 Claims, 1 Drawing Sheet

LIGHTWEIGHT INSULATED SPA COVER AND METHOD THEREFOR

BACKGROUND OF THE INVENTION

1. Field of the Invention

This invention relates to spa accessories and, more specifically, to a lightweight insulated spa cover that completely covers the exposed portion of an above ground spa to prevent heat loss from the water in the spa to the colder outside air above the water.

2. Description of the Prior Art

Spas and/or whirlpools (hereinafter spas) are being installed by more families every year. The main reason for this is that more and more people are realizing the healthful and relaxing benefits of spa bathing. Spas may be installed indoors or outdoors and may be used in any type of weather cold or hot. In fact, spas are being enjoyed in many winter ski resorts where the surrounding outdoor temperature may be quite cold.

When spas are placed outdoors, the cold ambient temperature results in considerable heat loss from the surface of the water to the cold outside air above the water. Even if the outdoor temperature is quite warm, there is still some heat loss since the water temperature in the spa is considerably warmer than the temperature of the outside air.

Heat loss in spas is extremely undesirable. This is due to the fact that a heat loss is also an energy loss since the water in the spa needs to be maintained at a certain temperature. Because of this, numerous types of spa covers have been designed.

Hansen et al., U.S. Pat. Nos. 5,619,759; 5,802,630; and 5,970,759 disclose several different insulated spa covers. Each of the spa covers has an outer ring which is used as a frame for the cover. An insulated foam material is then coupled to the outer ring frame. Each of the covers are fairly large and rigid. This makes each of the covers fairly bulky thus making them difficult to use when installing them and removing them from the spa.

Jacobs, U.S. Pat. No. 4,422,192; Perry, U.S. Pat. No. 4,847,925; and Black et al., U.S. Pat. No. 5,689,841 also disclose several different types of spa covers. Each of the covers comes in two or more sections. Each section is fairly rigid and are hinged together. Again, like the previous patents listed above, each of the covers are fairly bulky thus making them difficult to use when installing them and removing them from the spa.

Therefore, a need existed to provide an improved spa cover. The improved spa cover will be an insulated spa cover. The improved insulated cover will completely covers the exposed portion of an above ground spa to prevent heat loss from the water in the spa to the colder outside air above the water. The improved insulated spa cover will also be lightweight and non-rigid thus making the improved spa cover easy to install and remove.

SUMMARY OF THE INVENTION

In accordance with one embodiment of the present invention, it is an object of the present invention to provide an improved spa cover.

It is another object of the present invention to provide an improved spa cover that is an insulated spa cover.

It is still another object of the present invention to provide an improved insulated spa cover that will completely cover the exposed portion of an above ground spa to prevent heat loss from the water in the spa to the colder outside air above the water.

It is yet another object of the present invention to provide an improved insulated spa cover that will be lightweight and non-rigid thus making the improved spa cover easy to install and remove.

BRIEF DESCRIPTION OF THE PREFERRED EMBODIMENTS

In accordance with one embodiment of the present invention a lightweight insulated cover which may be easily installed and removed from an above ground spa is disclosed. The insulated spa cover a top section and four side walls coupled to the top section. The top section and the four side walls are comprised of an insulated layer, and a second layer coupled to a front and back surface of the insulated layer for protecting the insulated layer from moisture generated from the above ground spa and external weather conditions.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
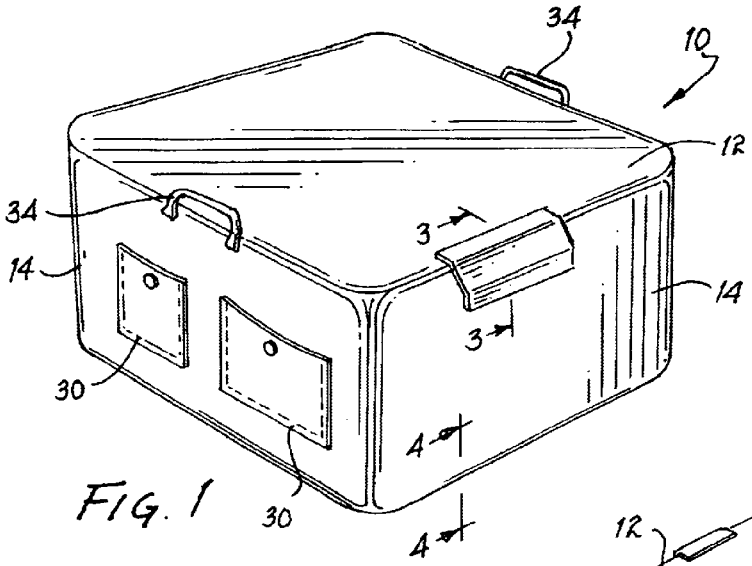
FIG. 1 is an elevated perspective view of the lightweight insulated spa cover of the present invention.

Referring to FIGS. 1–5 wherein like numerals and symbols represent like elements, a lightweight insulated spa cover 10 (hereinafter cover 10) is shown. The cover 10 is designed to fit over and completely cover the exposed portion of an above ground spa to prevent heat loss from the water in the spa to the colder outside air above the water. The cover 10 is generally shaped like a rectangular cube which fits over the above ground spa. However, the cover 10 may be constructed to fit over any shape above ground spa.

The cover 10 has a top section 12. Coupled to the top section 12 are four side wall sections 14. The side wall sections 14 may be coupled to the top section 12 by any manner. However, the side wall sections 14 should be fairly tightly coupled to the top section 12 in order to keep heat from escaping from the water in the spa.

The top section 12 and the side wall sections 14 are made out a combination of materials. In general, the top section 12 and the side wall sections 14 have an insulated layer 20. The insulated layer 20 is used to keep the heat from escaping from the water in the spa too the outside air. The insulated layer 20 should have a fairly high rating to best keep the heat from escaping. In accordance with one embodiment of the present invention, the insulated layer 20 has a rating of R-15. However, the insulated layer 20 may have a rating greater than or less than R-15 and this should not be seen as to limit the scope of the present invention.

Coupled to the insulated layer 20 is a second layer 22. The second layer 22 is coupled to both the top surface and the bottom surface of the insulated layer 20. The second layer 22 is used to protect the insulated layer 20 from the moisture generated from the spa as well as external weather conditions. The second layer 22 is generally made of a soft lightweight material. For example, the second layer may be cloth, felt, a light sponge material, etc. It should be noted that these are only examples and should not be seen as to limit the scope of the present invention.

The second layer 22 may be treated with a waterproof type of spray. The spray will treat the second layer 22 so that the second layer 22 will repel any liquid that comes in contact with the second layer 22. Alternatively, a third layer 24 may be coupled to the second layer 22. The third layer 24 would be a waterproof layer 24. The waterproof layer 24 may be coupled to either or both of the second layer 22. The waterproof layer 24 will be able to repel any moisture generated by the heat from the spa as well as repel any moisture from the outside environment.

Figure 2:
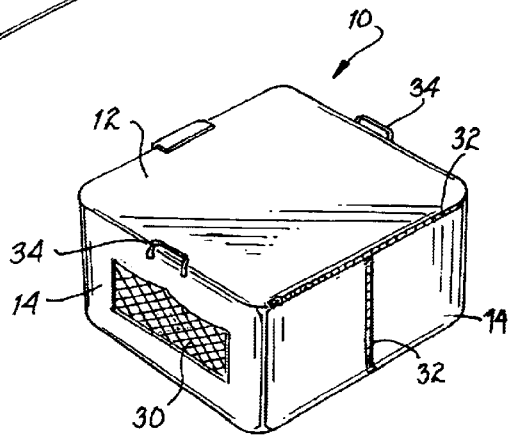
FIG. 2 is another elevated perspective view of the of the lightweight insulated spa cover of the present invention showing two different side walls.

In order to help in removing the cover 10 from the spa, handles 34 may be coupled to the cover 10. As shown in FIGS. 1 and 2, handles 34 are coupled to the side walls 14. Whenever someone would like to use the spa, he/she will use the handles to remove the cover 10 from the spa.

In order to further aid in the removal of the cover 10, a fastener mechanism 32 may be used. As may be seen more clearly in FIG. 2, the fastener mechanism 32 may be used to remove the top section 12 from the cover 10. In this manner, the fastener mechanism 32 is coupled to both the top section 12 and to three of the four side walls 14. The fastener mechanism 32 may then be used to loosen the top section 12 from the side walls 14. Once the fastener mechanism 32 is loosened, the top section 12 may then be folded back so that individuals may use the spa. The fastener mechanism 32 may also be used to remove the entire cover 10 from the above ground spa. As may be seen more clearly in FIG. 2, the fastener mechanism 32 may be used to hold two sections of the side wall 14 together. When the fastener mechanism 32 is loosened, the side wall 14 will come apart into two halves. The cover 10 may then be lifted up off of the spa. The fastener mechanism 32 may be hook and loop material, a zipper, or any similar item.

The side walls 14 may have one or more pocket sections 30 as may be seen more clearly in FIGS. 1 and 2. The pocket sections 30 may be a piece of material or mesh cloth which is coupled to the side wall 14. The pocket sections may be of various sizes. The pocket sections 30 are used to store items which may be used with the spa. For example, the pocket sections 30 may be used to hold towels, clothing, food and drinks, etc.

Figure 3:
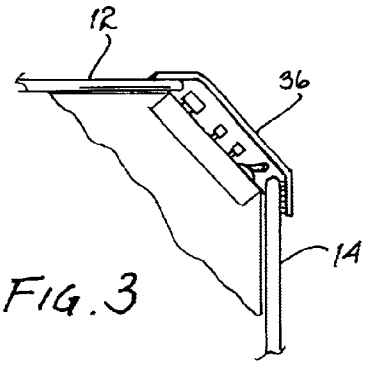
FIG. 3 is a cross-sectional view of the lightweight insulated spa cover depicted in FIG. 1 taken along lines 3—3.
Figure 4:
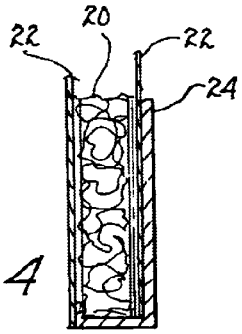
FIG. 4 is a cross-sectional view of the lightweight insulated spa cover depicted in FIG. 1 taken along lines 4—4.
Figure 5:
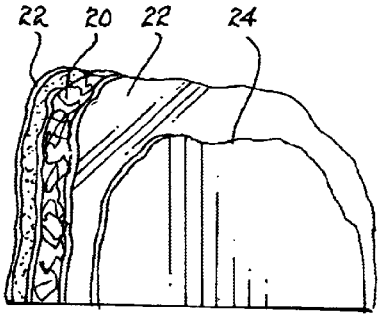
FIG. 5 shows the several different layers of the lightweight insulated spa cover of the present invention.

One of the side walls 14 may further have a cover section 36. The cover section 36 is best illustrated in FIG. 3. The cover section 36 is used to cover an opening between the side wall 14 and the top section 12. The opening is used so that any controls used to control the operation of the spa may be exposed with the cover still on the spa. The cover section 36 will have one end coupled to the top section 12 and a second end removably coupled to the side wall 14.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A lightweight and flexible insulated cover which will completely cover exposed portions of an above ground spa and which is easily installed and removed from the above ground spa comprising, in combination:

a top section which covers an open area of the above ground spa;

side walls coupled to the top section which covers all walls of the above ground spa wherein the top section and the side walls comprises:

a lightweight and flexible insulated layer; and a second layer which is also lightweight and flexible and is coupled to a front and back surface of the insulated layer for protecting the insulated layer from moisture generated from the above ground spa and external weather conditions; and a waterproof layer which is coupled to the second layer for further protecting the insulated layer from external weather conditions;

a fastener mechanism coupled to the top section and the side walls for removing the top section from the side walls and for further allowing an individual to partially separate the top section from the side wall to create a small opening to allow the individual to enter the above ground spa without having to fully remove the lightweight and flexible insulated cover.

2. A lightweight and flexible insulated cover which will completely cover all exposed portions of an above ground spa and which is easily installed and removed from the above ground spa in accordance with claim 1 wherein the second layer is made of a soft lightweight material that is one of cloth, felt, a light sponge material or combinations thereof.

3. A lightweight and flexible insulated cover which will completely cover all exposed portions of an above ground spa and which is easily installed and removed from the above ground spa in accordance with claim 1 wherein at least one side wall has pocket sections coupled to the at least one side wall for storing items.

4. A lightweight and flexible insulated cover which will completely cover all exposed portions of an above ground spa and which is easily installed and removed from the above ground spa in accordance with claim 1 further comprising handles coupled to the lightweight and flexible insulated cover for removing the lightweight and flexible insulated cover from the above ground spa.

5. A lightweight and flexible insulated cover which will completely cover all exposed portions of an above ground spa and which is easily installed and removed from the above ground spa in accordance with claim 1 wherein the fastener mechanism is hook and loop material.

6. A lightweight and flexible insulated cover which will completely cover all exposed portions of an above ground spa and which is easily installed and removed from the above ground spa in accordance with claim 1 wherein the fastener mechanism is a zipper.

7. A lightweight and flexible insulated cover which will completely cover all exposed portions of an above ground spa and which is easily installed and removed from the above ground spa in accordance with claim 1 further comprising a cover section coupled to the top section and removably coupled to at least one of the side walls for covering controls used to control operation of the above ground spa.

* * * * *